US012529182B2

(12) United States Patent
Patel et al.

(10) Patent No.: US 12,529,182 B2
(45) Date of Patent: Jan. 20, 2026

(54) DISPENSING ASSEMBLY FOR AN APPLIANCE USING A SINGLE MOTOR TO DRIVE MULTIPLE ITEMS

(71) Applicant: Haier US Appliance Solutions, Inc., Wilmington, DE (US)

(72) Inventors: Ravi Patel, Louisville, KY (US); Reagan Murphy, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 209 days.

(21) Appl. No.: 18/411,463

(22) Filed: Jan. 12, 2024

(65) Prior Publication Data

US 2025/0230601 A1 Jul. 17, 2025

(51) Int. Cl.

| | |
|---|---|
| ***A47L 15/44*** | (2006.01) |
| ***D06F 39/02*** | (2006.01) |
| ***D06F 39/08*** | (2006.01) |
| ***D06F 39/12*** | (2006.01) |
| *D06F 105/42* | (2020.01) |

(52) U.S. Cl.

CPC ..... *D06F 39/088* (2013.01); *A47L 15/44* (2013.01); *D06F 39/028* (2013.01); *D06F 39/12* (2013.01); *D06F 2105/42* (2020.02)

(58) Field of Classification Search

None

See application file for complete search history.

(56) References Cited

U.S. PATENT DOCUMENTS

2015/0107310 A1* 4/2015 Del Pos ..... D06F 39/007 68/17 R

FOREIGN PATENT DOCUMENTS

| | | | |
|---|---|---|---|
| CN | 203373569 | U | 1/2014 |
| CN | 212223372 | U | 12/2020 |
| CN | 114094336 | A | 2/2022 |
| CN | 114521857 | A | 5/2022 |
| CN | 218913613 | U | 4/2023 |

OTHER PUBLICATIONS

DE 4335600 A1 machine translation, Washing Machine And Hydraulic Distributor For Use In Such Machines, Da Pont (Year: 1994).*

* cited by examiner

*Primary Examiner* — Cristi J Tate-Sims

(74) *Attorney, Agent, or Firm* — Dority & Manning, P.A.

(57) ABSTRACT

A dishwasher appliance includes a tub defining a wash chamber; a door; at least one fluid storage vessel positioned within the wash chamber; and a dispenser assembly fluidly coupled with the at least one fluid storage vessel. The dispenser assembly includes a fluid diverter including a plurality of fluid inlet channels, a fluid outlet channel, and a diverter input shaft; a pump fluidly coupled to the fluid diverter and including a pump input shaft; and a bidirectional motor including an output shaft, wherein the output shaft is operably coupled to each of the diverter input shaft and the pump input shaft such that the diverter input shaft is rotated when the output shaft is rotated in a first rotational direction and the pump input shaft is rotated when the output shaft is rotated in a second rotational direction opposite the first direction.

18 Claims, 6 Drawing Sheets

DISPENSING ASSEMBLY FOR AN APPLIANCE USING A SINGLE MOTOR TO DRIVE MULTIPLE ITEMS

FIELD OF THE INVENTION

The present subject matter relates generally to domestic appliances, and more particularly to dispenser assemblies for dishwasher appliances.

BACKGROUND OF THE INVENTION

Common appliances may include dishwashers, washing machines, dryers, and other appliances. Certain appliances, such as washing machines and dishwashers generally include a tub that defines a wash chamber and a pump for directing fluids from a fluid reservoir into the wash chamber during washing operations.

Furthermore, dishwashers generally include a detergent dispenser for dispensing detergent into the wash chamber. Traditionally, such dispensers either mix the fluids or maintain distinct channels. For instance, a fluid diverter may be used to selectively allow a single fluid to flow into the wash chamber or tub. A pump is typically also required to pump the selected liquid into the desired location. However, existing applications require multiple actuators to operate each of the fluid diverter and the pump.

Accordingly, an appliance which obviates one or more of the above-mentioned drawbacks would be beneficial. In particular, a dispensing assembly for a dishwasher appliance using a single motor for a diverter and a pump would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a dishwasher appliance is provided. The dishwasher appliance may include a tub defining a wash chamber for receipt of articles for washing; a door movable between a closed position and an open position; at least one fluid storage vessel positioned within the wash chamber and configured to store a detergent; and a dispenser assembly fluidly coupled with the at least one fluid storage vessel. The dispenser assembly may include a fluid diverter including a plurality of fluid inlet channels, a fluid outlet channel, and a diverter input shaft; a pump fluidly coupled to the fluid diverter for selectively urging a flow of fluid from the fluid diverter into the wash chamber, the pump including a pump input shaft; and a bidirectional motor including an output shaft, wherein the output shaft is operably coupled to each of the diverter input shaft and the pump input shaft such that the diverter input shaft is rotated when the output shaft is rotated in a first rotational direction and the pump input shaft is rotated when the output shaft is rotated in a second rotational direction opposite the first direction.

In another exemplary aspect of the present disclosure, a dispenser assembly for an appliance is provided. The dispenser assembly may include a fluid diverter including a plurality of fluid inlet channels, a fluid outlet channel, and a diverter input shaft; a pump fluidly coupled to the fluid diverter for selectively urging a flow of fluid from the fluid diverter into the appliance, the pump including a pump input shaft; and a bidirectional motor including an output shaft, wherein the output shaft is operably coupled to each of the diverter input shaft and the pump input shaft such that the diverter input shaft is rotated when the output shaft is rotated in a first rotational direction and the pump input shaft is rotated when the output shaft is rotated in a second rotational direction opposite the first direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
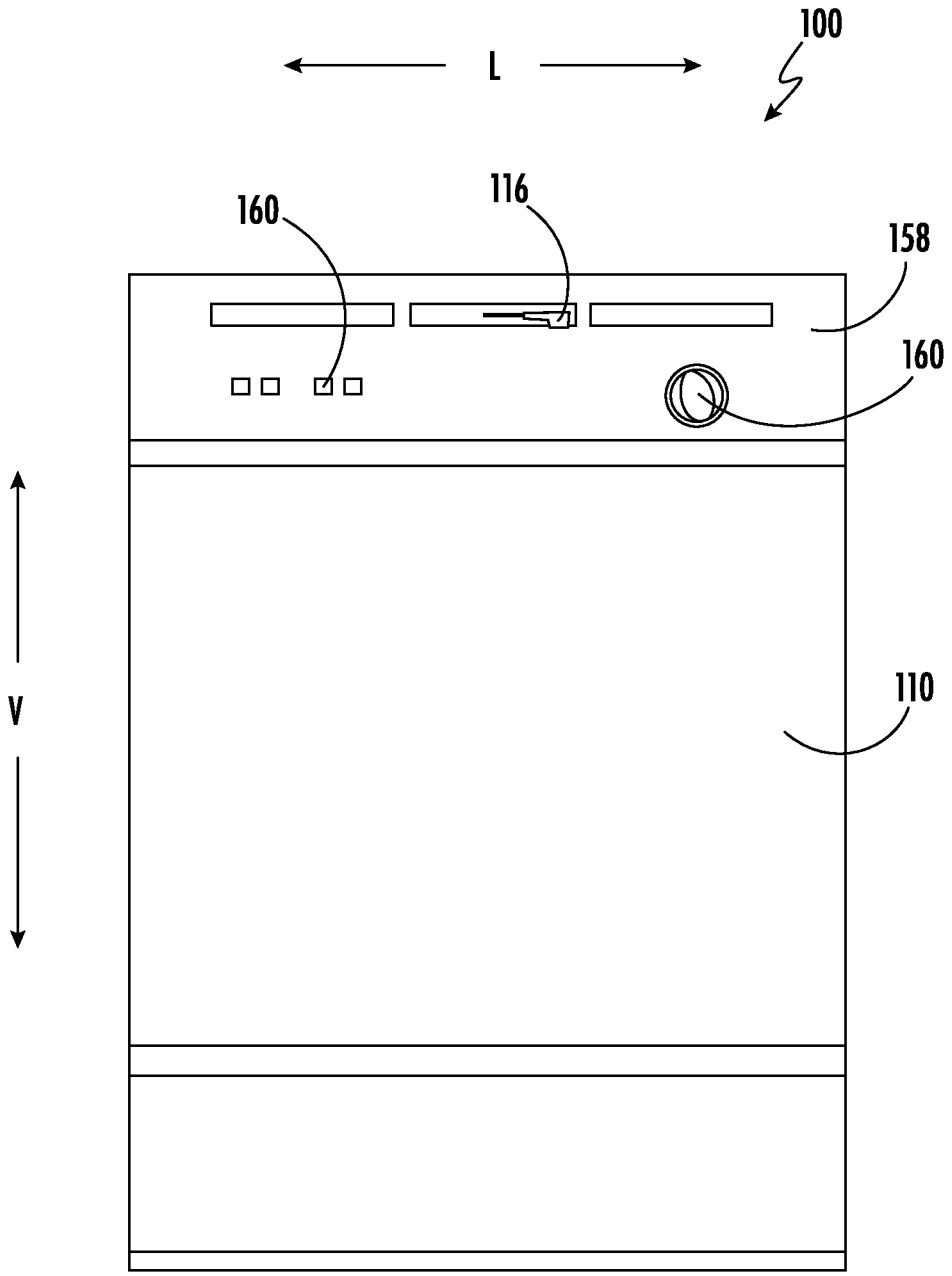
FIG. 1 provides a front view of a dishwashing appliance in accordance with an embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
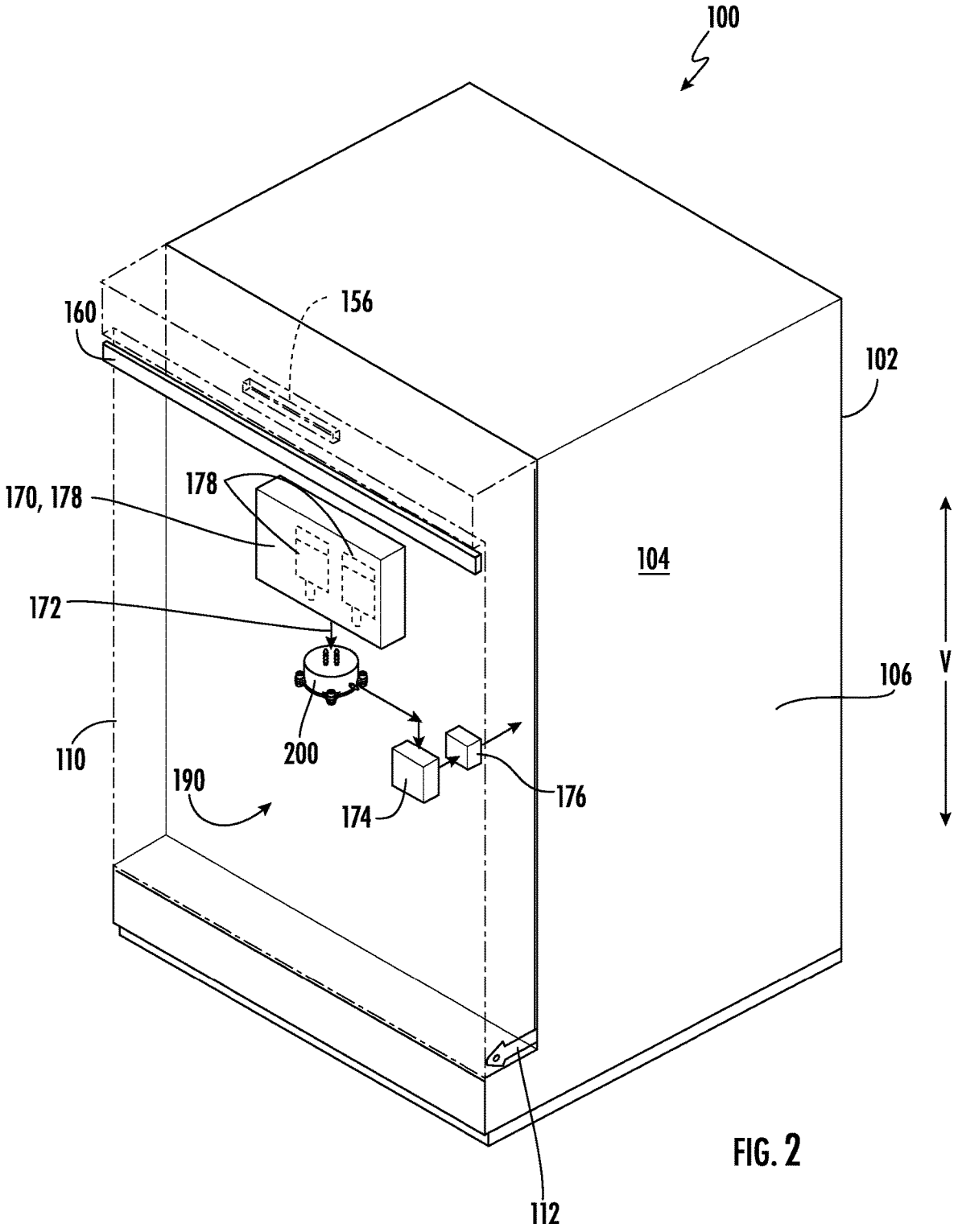
FIG. 2 provides a side, cross-sectional view of the dishwashing appliance of FIG. 1.

Referring now to the figures, FIGS. 1 and 2 illustrate a front view of an appliance that may be configured in accordance with aspects of the present disclosure. For the embodiment of FIGS. 1 and 2, the appliance is a dishwasher appliance 100. As shown particularly in FIG. 2, dishwasher appliance 100 includes a cabinet 102 having a tub 104 therein that defines a wash chamber 106 for the receipt of articles (e.g., dishes) for washing. Tub 104 may include a front opening and a door 110 for selectively opening and closing wash chamber 106. As shown, door 110 may be hinged to wash chamber 106 for movement between a closed position (shown in FIGS. 1 and 2) and an open position for loading and unloading articles into and from dishwasher 100. In addition, a latch 116 may be used to lock and unlock door 110 for selective access to wash chamber 106.

As shown in FIG. 2, dishwasher appliance 100 may be further equipped with a controller 156 to regulate operation of dishwasher appliance 100. Controller 156 may include one or more memory devices and one or more microprocessors, such as general or special purpose microprocessors operable to execute programming instructions or micro-control code associated with a cleaning cycle. The memory may represent random access memory such as DRAM or read only memory such as ROM or FLASH. In an embodiment, the processor executes programming instructions stored in the memory. The memory may be a separate component from the processor or may be included onboard within the processor. Further, controller 156 may be positioned in a variety of locations throughout dishwasher appliance 100. In the illustrated embodiment, for example, controller 156 is located within a control panel area 158 of door 110 as shown in FIG. 1. Typically, controller 156 includes a user interface panel/controls 160 through which a user may select various operational features and modes and monitor progress of dishwasher appliance 100.

Referring particularly to FIG. 2, dishwasher appliance 100 may include a fluid reservoir 170. For instance, fluid reservoir 170 may be a container, box, or other partially enclosed case or casing. Fluid reservoir 170 may include a plurality of fluid storage vessels 178 containing a plurality of fluids for washing and/or rinsing the articles within wash chamber 106. For instance, three, four, or more separate fluid storage vessels 178 may be contained within fluid reservoir 170, each fluid storage vessel 178 containing a distinct additive, such as detergent, sanitizer, deodorizer, or the like.

Dishwasher appliance 100 may include a pump 174 for directing or pumping the plurality of fluids from the fluid reservoir 170 (e.g., from one or more fluid storage vessels 178) and into wash chamber 106. Pump 174 may selectively pump fluid (e.g., detergent) from fluid storage vessel 178 (e.g., via a diverter, described below) according to certain wash cycle needs of dishwashing appliance 100. Accordingly, pump 174 may be any suitable pump. In at least one embodiment, pump 174 is a peristaltic pump. However, it should be understood that the described pump is provided by way of example only and the disclosure is not limited to the examples provided herein.

Dishwasher appliance 100 may include a dispenser assembly 190 for controlling the plurality of fluids 178 flowing from fluid reservoir 170 and into wash chamber 106 along a flow path 172. According to at least some embodiments, dispenser assembly 190 includes pump 174. Additionally or alternatively, dispenser assembly 190 may be in fluid communication with a dispenser 176 for dispensing one of the plurality of different fluids into wash chamber 106 at a time. As shown in FIG. 2, fluid reservoir 170, dispenser 176, and dispenser assembly 190 may be disposed within door 110. As such, FIG. 2 depicts fluid reservoir 170, dispenser assembly 190, and dispenser 176 as having a particular arrangement along flow path 172. However, it should be understood that such an arrangement is not limiting, and a variety of arrangements can be implemented in accordance with the present disclosure. For example, pump 174 and dispenser 176 may be arranged in a different order along flow path 172 such that dispenser 176 is positioned adjacent to or connected with dispenser assembly 190.

Dispenser assembly 190 may include a fluid diverter 200. For instance, referring to FIG. 3, a perspective view of fluid diverter 200 according to an exemplary embodiment of the present disclosure is illustrated. Fluid diverter 200 may be used with a variety of appliances, such as dishwasher appliance 100 of FIGS. 1 and 2. As shown, fluid diverter 200 may include a housing 210 having a plurality of inlets 216 and an outlet 218. In an embodiment, the plurality of inlets 216 may extend from housing 210 in a first direction (e.g., upward along the vertical direction V), whereas outlet 218 may extend from housing 210 in a second direction different from the first direction (e.g., outward along the transverse direction T). As such, in an embodiment, first and second directions may be generally perpendicular. Further, the plurality of inlets 216 may include any suitable number of inlets, such as four separate inlets as shown. In further embodiments, fluid diverter 200 can have more or less than four separate inlets. For instance, the number of inlets 216 may correspond to a number of fluid storage vessels 178 within fluid reservoir 170.

Housing 210 of fluid diverter 200 may include a first housing portion 212 and a second housing portion 214. For instance, first housing portion 212 may be detachably secured to second housing portion 214. First housing portion 212 and second housing portion 214 may be secured together via one or more fasteners 206. Fasteners 206 may include a variety of different fasteners, such as screws, nuts and bolts, or any other suitable fasteners. Additionally or alternatively, first housing portion 212 and second housing portion 214 may each include a plurality of projections 202 and 204, respectively, for securing first housing portion 212 with second housing portion 214. For example, the plurality of projections 202, 204 of first and second housing portions 212, 214 may be aligned and fasteners 206 may extend therethrough.

Figure 3:
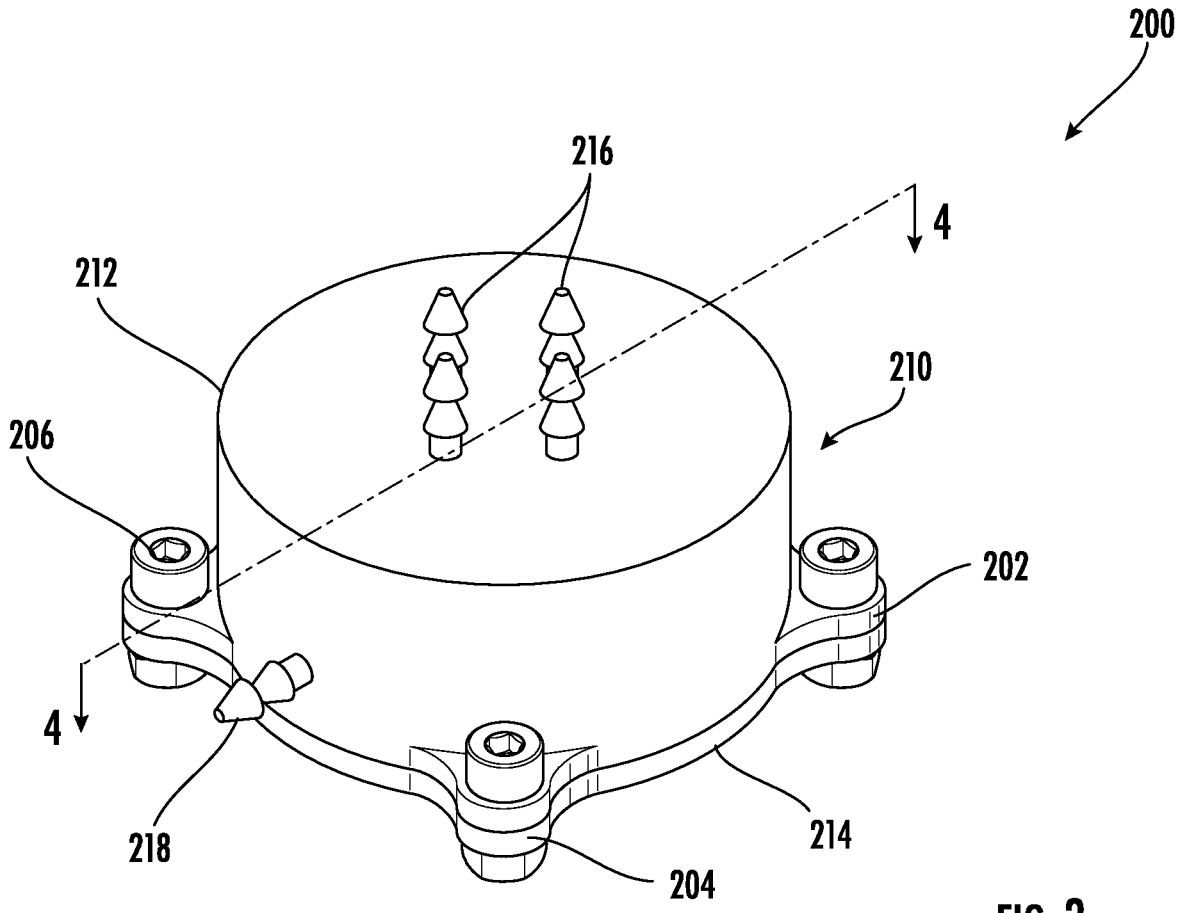
FIG. 3 provides a perspective view of a fluid diverter in accordance with an embodiment of the present disclosure.
Figure 4:
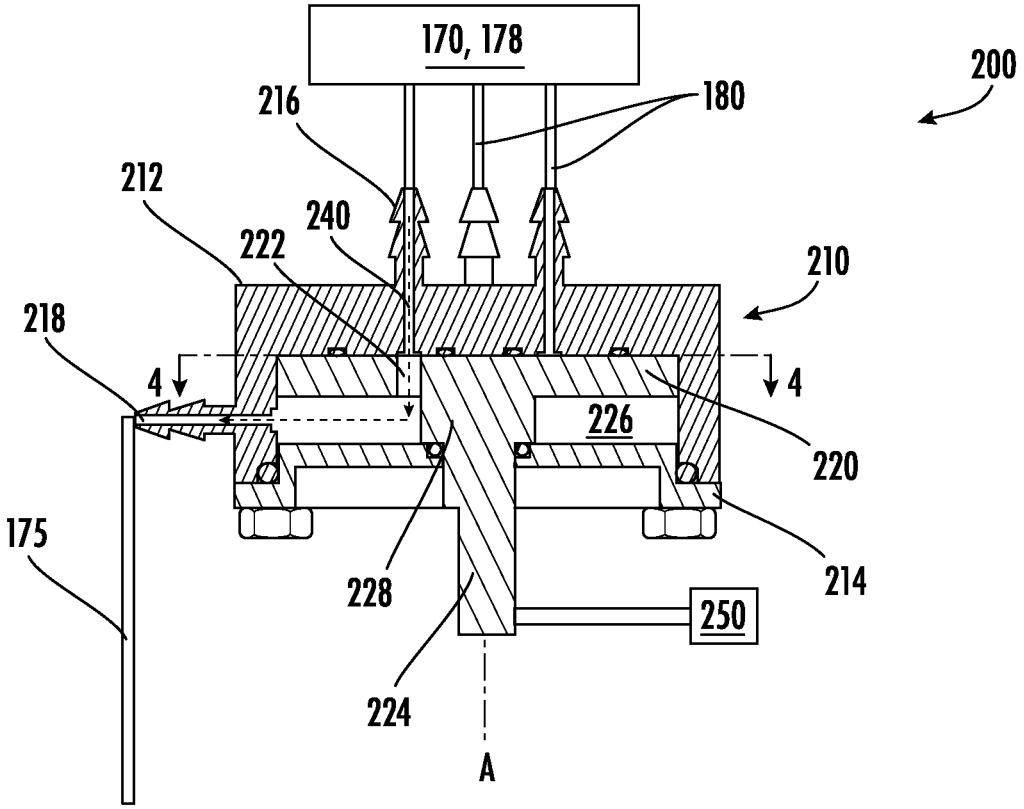
FIG. 4 provides a cross sectional view of the fluid diverter of FIG. 3 along line 4-4.
Figure 5:
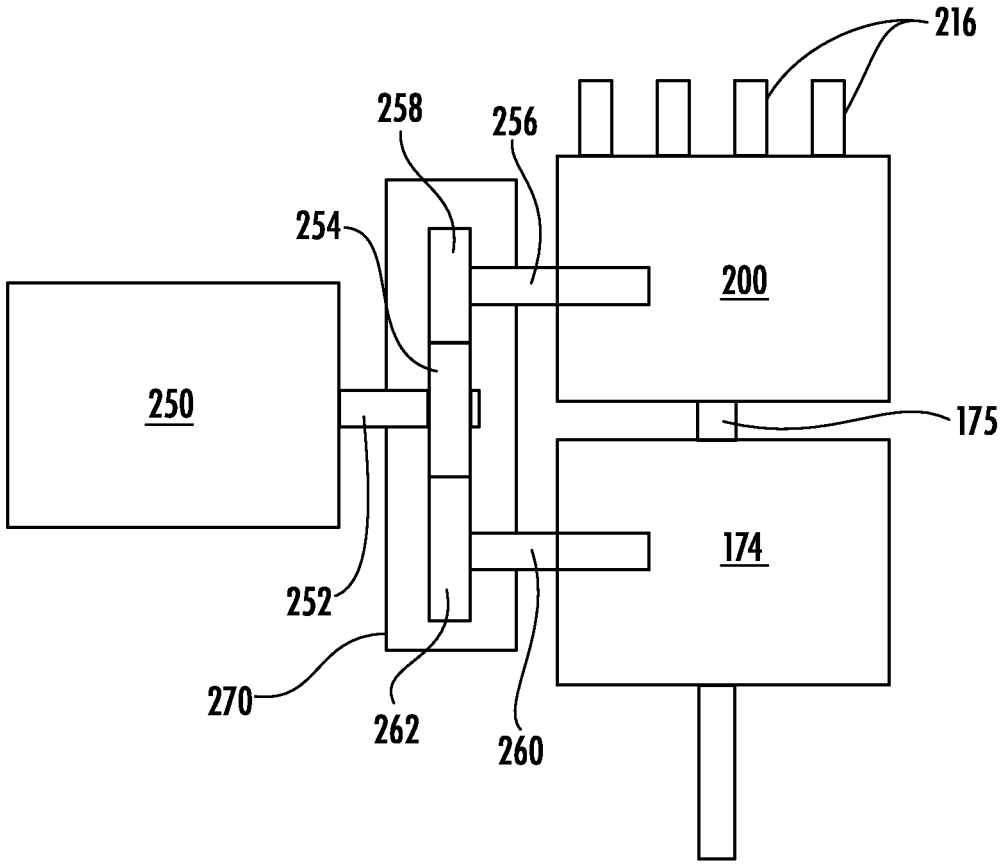
FIG. 5 provides a schematic side cutaway view of a dispenser assembly according to exemplary embodiments of the present disclosure.
Figure 6:
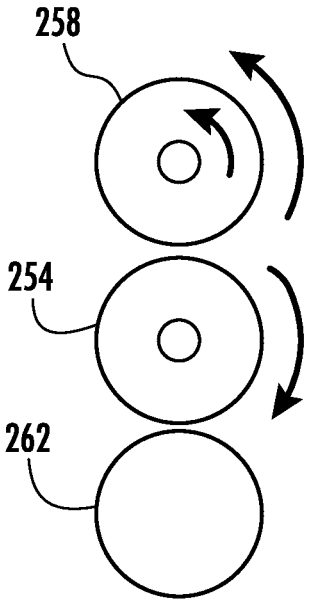
FIG. 6 provides a schematic axial view of a gearing connection according to a first rotational direction of the exemplary dispenser assembly of FIG. 5.
Figure 7:
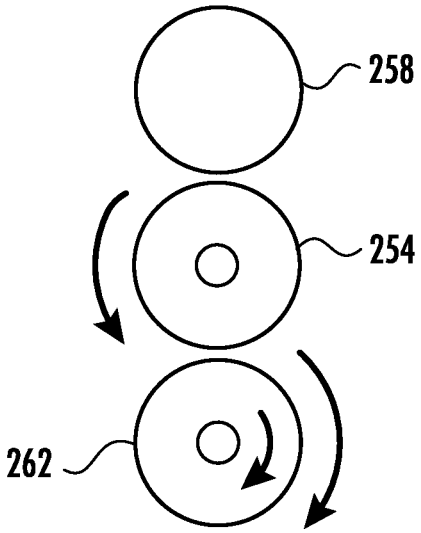
FIG. 7 provides a schematic axial view of a gearing connection according to a second rotational direction of the exemplary dispenser assembly of FIG. 5.

Referring now to FIG. 4, a cross-sectional view of fluid diverter 200 of FIG. 3 along line 4-4 is illustrated. Fluid diverter 200 may include a rotatable disk 220 positioned within housing 210. Rotatable disk 220 may define an aperture 222 which may be selectively aligned with one of the plurality of inlets 216 of housing 210. Thus, the fluid contained in a selected fluid storage vessel 178 may flow into housing 210 via its respective inlet 216 via aperture 222. For instance, one or more conduits 180 may be included between fluid reservoir 170 and fluid diverter 200. The fluids may thus flow from the selected fluid storage vessel 178 into fluid diverter 200 via conduit 180. Accordingly, a flow path 240 may be formed between one of the plurality of inlets 216 and outlet 218 through housing 210.

A fluid volume 226 may be defined within housing 210. For instance, fluid volume 226 may be defined between first housing portion 212 and second housing portion 214. In some embodiments, fluid volume 226 is defined between second housing portion 214 and rotatable disk 220. In such embodiments, rotatable disk 220 includes protrusion 224 extending through second housing portion 214 and beyond housing 210 (e.g., outside of housing 210). Rotatable disk 220 may include a gauge section 228 formed between protrusion 224 and aperture 222. Gauge section 228 may not extend through or beyond second housing portion 214. For instance, gauge section 228 may be located inside housing 210 and may abut second housing portion 214. Gauge section 228 may separate aperture 222 of rotatable disk 220 from second housing portion 214 such that fluid volume 226 is defined between second housing portion 214 and rotatable disk 220. Thus, flow path 240 may pass through fluid volume 226.

The fluid dispensed from the selected fluid storage vessel 178 may then flow from diverter 200 into pump 174 via a pump line 175. For instance, after the fluid has been dispensed, flowed, or otherwise urged from fluid reservoir 170 to fluid diverter 200, pump 174 may be initiated (e.g., via a signal from controller 156). As mentioned above, pump 174 may be a peristaltic pump. Accordingly, a predetermined amount of the fluid may be pumped into wash chamber 106.

Dispenser assembly 190 may include a motor 250. Motor 250 may be a bidirectional motor. For instance, motor 250 may be capable of rotating in two directions (e.g., clockwise and counterclockwise). As used herein, "motor" may refer to any suitable drive motor and/or transmission assembly. For example, motor 250 may be referred to as a motor assembly and may include a brushless DC electric motor, a stepper motor, or any other suitable type or configuration of motor. For example, the motor assembly may include an AC motor, an induction motor, a permanent magnet synchronous motor, or any other suitable type of AC motor. In addition, the motor assembly may include any suitable transmission assemblies, clutch mechanisms, or other components. For instance, motor 250 may be configured to rotate in both rotational directions alone or may include one or more transitional gears to selectively change the rotational direction of an output shaft of motor 250. According to an exemplary embodiment, motor 250 is operably coupled to controller 156, which is programmed to rotate motor 250 as described herein.

Motor 250 may be operably connected or coupled with or to each of fluid diverter 200 and pump 174. In detail, motor 250 may include an output shaft 252. As mentioned above, motor 250 may be a motor assembly including potential transmission assemblies. As such, output shaft 252 may include any shaft configured to receive rotational force from motor 250. Output shaft 252 may thus be configured to rotate in each of a clockwise direction and a counterclockwise direction. Output shaft 252 may be any suitable shaft, including any one of a cylindrical shaft, a notched shaft, or the like.

Output shaft 252 may include an output gear 254. Output gear 254 may be any suitable toothed gear capable of transferring rotational energy from output shaft 252 to a separate, independent shaft (e.g., via one or more additional gears). However, output gear 254 may have any suitable shape, such as a conical gear, a work gear, or the like, and the description is not limited to the examples provided herein. Output gear 254 may be fixed to output shaft 252. Accordingly, output gear 254 may be restricted from freely rotating with respect to output shaft 252.

Fluid diverter 200 may include a diverter input shaft 256. For instance, diverter input shaft 256 may be rotatably connected to rotatable disk 220 (e.g., at protrusion 224). Diverter input shaft 256 may thus be configured to transmit or transfer rotational energy to rotatable disk 220 (e.g., to rotate rotatable disk 220 to a predetermined location to open one of the plurality of inlets 216). Diverter input shaft 256 may be any suitable shaft. According to some embodiments, diverter input shaft 256 extends into fluid diverter 200.

Diverter input shaft 256 may be operably (e.g., rotationally) connected with output shaft 252 of motor 250. For instance, diverter input shaft 256 may include a diverter input gear 258. Diverter input gear 258 may be positioned at or near a distal end of diverter input shaft 256. Accordingly, diverter input gear 258 may be meshed with output gear 254. As would be expected, diverter input gear 258 may receive a rotational input from output gear 254 when motor 250 is driven. Thus, as motor 250 is rotated in a predetermined direction, diverter input shaft 256 may be rotated, in turn rotating rotatable disk 220.

Diverter input gear 258 may be a ratchet gear. For instance, diverter input gear 258 may be unidirectional ratchet gear. Diverter input gear 258 may thus be configured to rotate in a single direction (e.g., either clockwise or counterclockwise). Diverter input gear 258 may therefore include an inner annular ring fixed to diverter input shaft 256. The inner annular ring may include a plurality of ramps (e.g., extending radially outward from an outer circumferential surface thereof). An outer annular gear may be positioned around the inner annular ring. The outer annular gear may include one or more pawls movably attached to an inner circumferential surface thereof. The one or more pawls may selectively engage with the plurality of ramps of the inner annular ring when diverter input shaft 256 is rotated in a first direction (e.g., clockwise). Thus, the outer annular gear may include a plurality of gear teeth protruding from an outer circumferential surface thereof. The plurality of gear teeth may be meshed with output gear 254. Accordingly, when output shaft 252 is rotated in a second direction (e.g., counterclockwise), the outer annular ring may not rotate due to the pawls ramping over the plurality of ramps. As such, diverter input shaft 256 may also be restricted from rotating.

Pump 174 may include a pump input shaft 260. For instance, pump input shaft 260 may be configured to transmit or transfer rotational energy to pump 174 (e.g., to cause pump 174 to release, deliver, or otherwise pump a selected liquid into wash chamber 106). Pump input shaft 260 may be any suitable shaft. According to some embodiments, pump input shaft 260 extends into pump 174.

Pump input shaft 260 may be operably (e.g., rotationally) connected with output shaft 252 of motor 250. For instance, pump input shaft 260 may include a pump input gear 262. Pump input gear 262 may be positioned at or near a distal end of pump input shaft 260. Accordingly, pump input gear 262 may be meshed with output gear 254. As would be expected, pump input gear 262 may receive a rotational input from output gear 254 when motor 250 is driven. Thus, as motor 250 is rotated in a predetermined direction, pump input shaft 260 may be rotated, in turn rotating pump 174.

Pump input gear 262 may be a ratchet gear. For instance, pump input gear 262 may be unidirectional ratchet gear. Pump input gear 262 may thus be configured to rotate in a single direction (e.g., either clockwise or counterclockwise). Pump input gear 262 may therefore include an inner annular ring fixed to pump input shaft 260. The inner annular ring may include a plurality of ramps (e.g., extending radially outward from an outer circumferential surface thereof). An outer annular gear may be positioned around the inner annular ring. The outer annular gear may include one or more pawls movably attached to an inner circumferential surface thereof. The one or more pawls may selectively engage with the plurality of ramps of the inner annular ring when pump input shaft 260 is rotated in a second direction (e.g., counterclockwise, opposite from the first direction mentioned above). Thus, the outer annular gear may include a plurality of gear teeth protruding from an outer circumferential surface thereof. The plurality of gear teeth may be meshed with output gear 254. Accordingly, when output shaft 252 is rotated in the first direction (e.g., clockwise), the outer annular ring may not rotate due to the pawls ramping over the plurality of ramps. As such, pump input shaft 260 may also be restricted from rotating.

Figure 8:
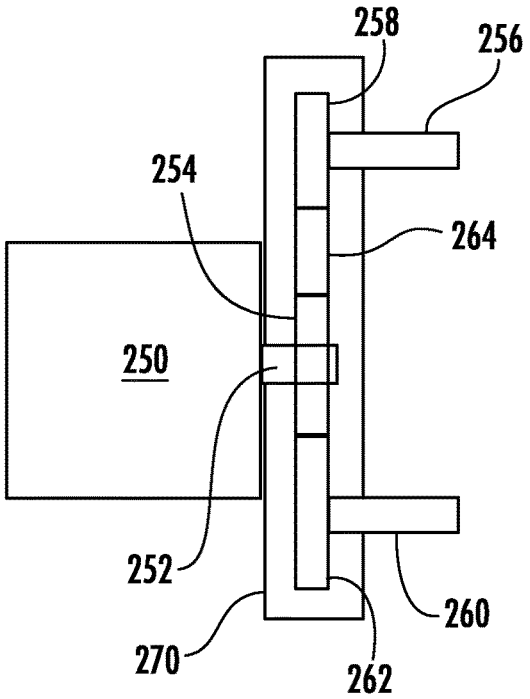
FIG. 8 provides a schematic side cutaway view of a dispenser assembly according to exemplary embodiments of the present disclosure.

As mentioned above, motor 250 may include a transmission assembly. For instance, referring briefly to FIG. 8, the transmission assembly may include a transition gear 264. Transition gear 264 may be operably connected with each of output gear 254 and either diverter input gear 258 or pump input gear 262. Transition gear 264 may function to switch a rotation direction of the connected input gear. For sake of explanation, according to this example, transition gear 264 is connected between output gear 254 and diverter input gear 258. Further to the example above, when motor 250 is driven in the first direction (e.g., clockwise) such that motor shaft 252 rotates in the first direction, transition gear 264 may be rotated in the second direction (e.g., counterclockwise). As such, diverter input gear 258 may then be rotated in the first direction (e.g., clockwise). Accordingly, each of diverter input shaft 256 and pump input shaft 260 may be rotated in the first direction (e.g., clockwise) regardless of the rotational direction of motor 250.

Dispenser assembly 190 may include a gearbox 270. Gearbox 270 may be positioned between motor 250 and each of fluid diverter 200 and pump 174. For instance, output shaft 252 of motor 250 may extend between motor 250 and gearbox 270. Similarly, diverter input shaft 256 may extend between fluid diverter 200 and gearbox 270. Further still, pump input shaft 260 may extend between pump 174 and gearbox 270. Each of output gear 254, diverter input gear 258, and pump input gear 262 may be positioned within gearbox 270. According to some embodiments, transition gear 264 may be positioned within gearbox 270. As would be understood, one or more additional gears may be provided within gearbox 270 and operably coupled with one or more of output gear 254, diverter input gear 258, pump input gear 262, transition gear 264, or the like.

Figure 9:
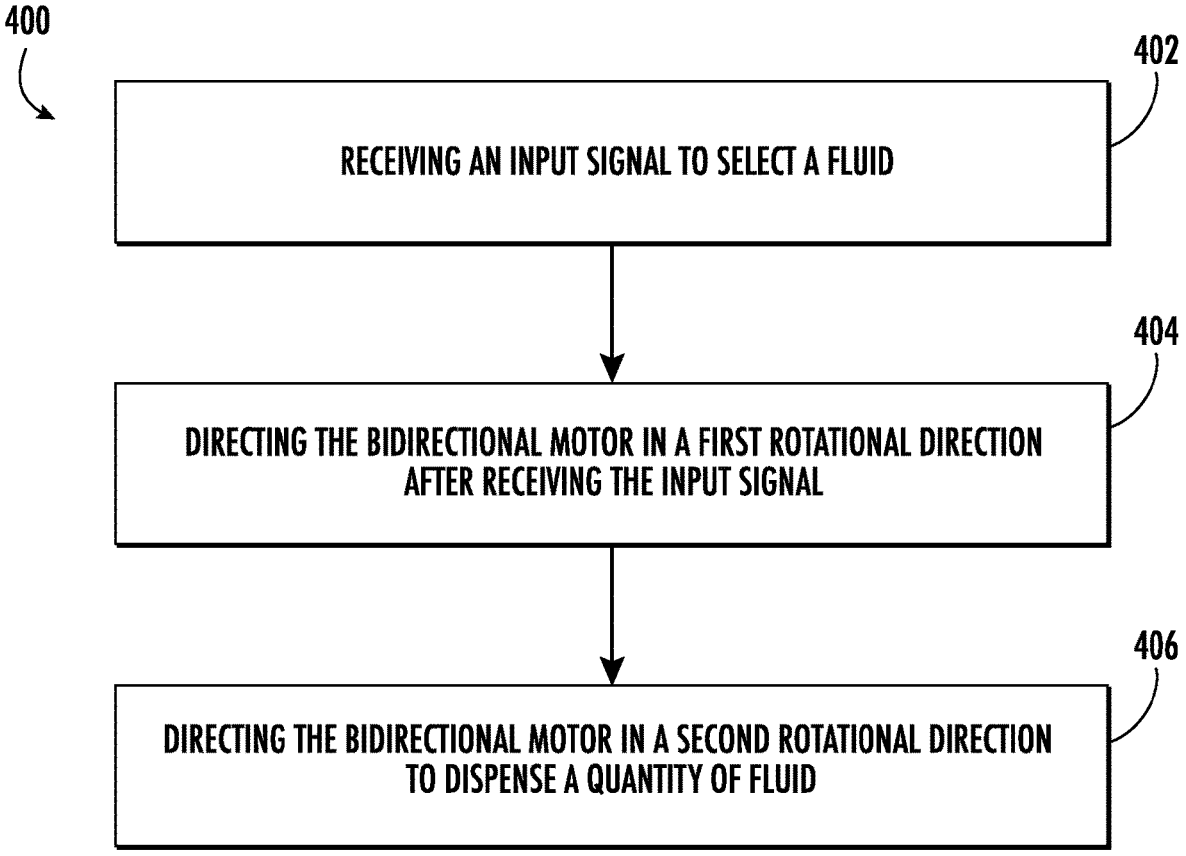
FIG. 9 provides a flow chart illustrating a method of operating an appliance according to exemplary embodiments of the present disclosure.

Now that the general descriptions of an exemplary appliance have been described in detail, a method 400 of operating an appliance (e.g., dishwasher appliance 100) will be described in detail. Although the discussion below refers to the exemplary method 400 of operating appliance 100, one skilled in the art will appreciate that the exemplary method 400 is applicable to any suitable domestic appliance capable of performing a motorized operation requiring gearing. In exemplary embodiments, the various method steps as disclosed herein may be performed by controller 156 and/or a separate, dedicated controller. FIG. 9 provides a flow chart illustrating a method of operating a dishwasher appliance. Hereinafter, method 400 will be described with specific reference to FIG. 9.

At step 402, method 400 may include receiving an input signal to select a fluid from the at least one fluid storage vessel. In detail, a user may select one of a plurality of washing operations via a user interface of the appliance. The selected washing operation may require a specific fluid (e.g., detergent, disinfectant, etc.) from a fluid storage vessel (e.g., fluid storage vessel 178) within the appliance. The user selection may be made via any suitable manner, such as manual input, remote input, or the like.

At step 404, method 400 may include directing the bidirectional motor in a first rotational direction after receiving the input signal. For instance, the selected fluid for the selected washing operation may require a rotation of a fluid diverter (e.g., fluid diverter 200) to allow the selected fluid to flow towards a pump (e.g., pump 174). Accordingly, a connected motor (e.g., motor 250) may be directed according to the first direction to rotate the fluid diverter to a correct position. The first direction may be predetermined (e.g., as clockwise or counterclockwise). The motor may be directed to rotate a predetermined amount such that a selection disk (e.g., rotatable disk 220) rotates through a predetermined arc length to align an aperture with the correct fluid inlet. Thus, the motor may be stopped upon reaching the required alignment of the aperture and the inlet.

At step 406, method 400 may include directing the bidirectional motor in the second rotational direction to dispense a quantity of the fluid (e.g., detergent) from the selected storage vessel. For instance, at step 404, the motor may be rotated in the clockwise direction. Accordingly, at step 406, the motor may be rotated in the counterclockwise direction. As mentioned above, the motor may be connected to each of a fluid diverter and a pump. As the motor is rotated in the first direction, only the fluid diverter input shaft (e.g., diverter input shaft 256) may rotate as the diverter input gear (e.g., unidirectional diverter input gear 258) is activated. Subsequently, as the motor is rotated in the second direction (e.g., counterclockwise), only the pump input shaft (e.g., pump input shaft 260) may rotate as the pump input gear (e.g., pump input gear 262) is activated. As mentioned above, each of the one-way, unidirectional gears may only be activated to turn their respective shaft when the motor is rotated in the corresponding direction. Advantageously, a single motor may be connected to each of the fluid diverter and the pump to operate each depending on the rotational direction of the motor.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance comprising:

a tub defining a wash chamber for receipt of articles for washing;

a door movable between a closed position and an open position;

at least one fluid storage vessel positioned within the wash chamber and configured to store a detergent; and a dispenser assembly fluidly coupled with the at least one fluid storage vessel, the dispenser assembly comprising:

a fluid diverter comprising a plurality of fluid inlet channels, a fluid outlet channel, and a diverter input shaft;

a pump fluidly coupled to the fluid diverter for selectively urging a flow of fluid from the fluid diverter into the wash chamber, the pump comprising a pump input shaft; and a bidirectional motor comprising an output shaft, wherein the output shaft is operably coupled to each of the diverter input shaft and the pump input shaft such that the diverter input shaft is rotated when the output shaft is rotated in a first rotational direction and the pump input shaft is rotated when the output shaft is rotated in a second rotational direction opposite the first direction.

2. The dishwasher appliance of claim 1, wherein the dispenser assembly further comprises:

an output gear fixed to the output shaft;

a first unidirectional ratchet gear operably coupled with the diverter input shaft and the output gear, the first unidirectional ratchet gear configured to rotate the diverter input shaft only when the output shaft is rotated in the first rotational direction, and a second unidirectional ratchet gear operably coupled with the pump input shaft and the output gear, the second unidirectional ratchet gear configured to rotate the pump input shaft only when the output shaft is rotated in the second rotational direction.

3. The dishwasher appliance of claim 2, wherein the dispenser assembly further comprises:

a gearbox positioned between the bidirectional motor and each of the fluid diverter and the pump, wherein the output gear, the first unidirectional ratchet gear, and the second unidirectional ratchet gear are positioned within the gearbox.

4. The dishwasher appliance of claim 2, wherein the dispenser assembly further comprises:

a transition gear operably coupled between the output gear and the first unidirectional ratchet gear.

5. The dishwasher appliance of claim 1, wherein the pump is a peristaltic pump.

6. The dishwasher appliance of claim 1, wherein the diverter comprises:

a housing comprising a plurality of inlets and an outlet;

a rotatable disk positioned within the housing, the rotatable disk comprising an aperture for being selectively aligned with one of the plurality of inlets to provide a flow path between one of the plurality of inlets and the outlet.

7. The dishwasher appliance of claim 6, wherein the diverter input shaft is operably coupled with the rotatable disk.

8. The dishwasher appliance of claim 6, wherein the at least one fluid storage vessel comprises a plurality of fluid storage vessels, each of the plurality of storage vessels being fluidly coupled with an individual inlet of the plurality of inlets of the housing.

9. The dishwasher appliance of claim 1, further comprising:

a controller operably coupled with the bidirectional motor, the controller configured to perform an operation, the operation comprising:

receiving an input signal to select a fluid from the at least one fluid storage vessel;

directing the bidirectional motor in the first rotational direction after receiving the input signal to select the at least one storage vessel; and directing the bidirectional motor in the second rotational direction to dispense a quantity of the detergent from the at least one storage vessel into the wash chamber via the pump.

10. A dispenser assembly for an appliance, the dispenser assembly comprising:

a fluid diverter comprising a plurality of fluid inlet channels, a fluid outlet channel, and a diverter input shaft;

a pump fluidly coupled to the fluid diverter for selectively urging a flow of fluid from the fluid diverter into the appliance, the pump comprising a pump input shaft; and a bidirectional motor comprising an output shaft, wherein the output shaft is operably coupled to each of the diverter input shaft and the pump input shaft such that the diverter input shaft is rotated when the output shaft is rotated in a first rotational direction and the pump input shaft is rotated when the output shaft is rotated in a second rotational direction opposite the first direction.

11. The dispenser assembly of claim 10, further comprising:

an output gear fixed to the output shaft;

a first unidirectional ratchet gear operably coupled with the diverter input shaft and the output gear, the first unidirectional ratchet gear configured to rotate the diverter input shaft only when the output shaft is rotated in the first rotational direction, and a second unidirectional ratchet gear operably coupled with the pump input shaft and the output gear, the second unidirectional ratchet gear configured to rotate the pump input shaft only when the output shaft is rotated in the second rotational direction.

12. The dispenser assembly of claim 11, further comprising:

a gearbox positioned between the bidirectional motor and each of the fluid diverter and the pump, wherein the output gear, the first unidirectional ratchet gear, and the second unidirectional ratchet gear are positioned within the gearbox.

13. The dispenser assembly of claim 11, further comprising:

a transition gear operably coupled between the output gear and the first unidirectional ratchet gear.

14. The dispenser assembly of claim 10, wherein the pump is a peristaltic pump.

15. The dispenser assembly of claim 10, wherein the diverter comprises:

a housing comprising a plurality of inlets and an outlet;

a rotatable disk positioned within the housing, the rotatable disk comprising an aperture for being selectively aligned with one of the plurality of inlets to provide a flow path between one of the plurality of inlets and the outlet.

16. The dispenser assembly of claim 15, wherein the diverter input shaft is operably coupled with the rotatable disk.

17. The dispenser assembly of claim 15, further comprising:

a plurality of fluid storage vessels, each of the plurality of storage vessels being fluidly coupled with an individual inlet of the plurality of inlets of the housing.

18. The dispenser assembly of claim 10, wherein the appliance is a dishwasher appliance defining a wash chamber, and wherein the dispenser assembly is positioned within the wash chamber.

* * * * *